US008542855B2

(12) United States Patent
Elmedyb et al.

(10) Patent No.: US 8,542,855 B2
(45) Date of Patent: Sep. 24, 2013

(54) SYSTEM FOR REDUCING ACOUSTIC FEEDBACK IN HEARING AIDS USING INTER-AURAL SIGNAL TRANSMISSION, METHOD AND USE

(75) Inventors: Thomas Bo Elmedyb, Smørum (DK); Jesper Jensen, Smørum (DK); Meng Guo, Smørum (DK)

(73) Assignee: Oticon A/S, Smorum (DK)

( * ) Notice: Subject to any disclaimer, the term of this patent is extended or adjusted under 35 U.S.C. 154(b) by 1094 days.

(21) Appl. No.: 12/506,635

(22) Filed: Jul. 21, 2009

(65) Prior Publication Data

US 2010/0020995 A1 Jan. 28, 2010

(30) Foreign Application Priority Data

Jul. 24, 2008 (EP) ..... 08104858.9

(51) Int. Cl.
*H04R 25/00* (2006.01)

(52) U.S. Cl.
USPC ..... 381/312; 381/23.1; 381/315

(58) Field of Classification Search
USPC ..... 381/23.1, 312, 313, 314, 315, 317, 381/318, 320, 321, 71.6, 92, 93
See application file for complete search history.

(56) References Cited

U.S. PATENT DOCUMENTS

| | | | | |
|---|---|---|---|---|
| 5,434,924 | A * | 7/1995 | Jampolsky | 381/23.1 |
| 5,991,419 | A | 11/1999 | Brander | |
| 6,549,633 | B1 * | 4/2003 | Westermann | 381/312 |
| 2004/0057591 | A1 | 3/2004 | Beck et al. | |
| 2004/0175008 | A1 | 9/2004 | Roeck et al. | |
| 2007/0076910 | A1 | 4/2007 | Sporer | |
| 2010/0135500 | A1 * | 6/2010 | Derleth et al. | 381/23.1 |

FOREIGN PATENT DOCUMENTS

| | | | |
|---|---|---|---|
| EP | 1 657 958 | A1 | 5/2006 |
| EP | 1 843 633 | A2 | 10/2007 |
| EP | 1 879 426 | A2 | 1/2008 |
| WO | WO-99/43185 | A1 | 8/1999 |
| WO | WO-2007/063139 | A2 | 6/2007 |

* cited by examiner

*Primary Examiner* — Huyen D Le
(74) *Attorney, Agent, or Firm* — Birch, Stewart, Kolasch & Birch, LLP

(57) ABSTRACT

The invention relates to a hearing aid system comprising first and second spatially separated hearing instruments, the system being adapted for processing input sounds to output sounds according to a user's needs. The invention further relates to a method and use. The object of the present invention is to provide an alternative scheme for reducing the effect of acoustic feedback in a hearing aid system. The problem is solved in that the hearing instruments comprises, respectively, first and second input transducers for converting a first input sound to first and second electric input signal, and first and second output transducers for converting first and second processed electric output signal to first and second output sounds, wherein the system is adapted to provide that a first Tx-signal originating from the first electric input signal of the first hearing instrument is transmitted to the second hearing instrument and used in the formation of the second processed electric output signal, and that a second Tx-signal originating from the second electric input signal of the second hearing instrument is transmitted to the first hearing instrument and used in the formation of the first processed electric output signal. This has the advantage of providing a scheme for reducing or effectively eliminating acoustic feedback in a pair of hearing instruments. The invention may e.g. be used in listening devices, e.g. hearing aids, head sets, or active ear plugs.

30 Claims, 7 Drawing Sheets

-- PRIOR ART --

SYSTEM FOR REDUCING ACOUSTIC FEEDBACK IN HEARING AIDS USING INTER-AURAL SIGNAL TRANSMISSION, METHOD AND USE

TECHNICAL FIELD

The invention relates to feedback cancellation in listening devices. The invention relates specifically to a hearing aid system comprising first and second spatially separated hearing instruments, the system being adapted for processing input sounds to output sounds according to a user's needs.

The invention furthermore relates to a method of reducing acoustic feedback in a hearing aid system comprising first and second hearing instruments, each for processing an input sound to an output sound according to a user's needs and to use of a hearing aid system.

The invention may e.g. be useful in applications such as listening devices, e.g. hearing aids, headsets or active ear plugs.

BACKGROUND ART

The following account of the prior art relates to one of the areas of application of the present invention, hearing aids.

The acoustic leakage from the receiver to the microphone of a hearing aid (in particular such hearing aids where microphone and receiver are located at a short distance from each other) may lead to feedback instability or oscillation when the gain in hearing aid is increased above a certain point. The condition for instability is given by the Nyquist criterion that provides that oscillation will occur at any frequency where the phase change around the loop is a multiple of 360 degrees AND the loop gain is greater than 1.

In traditional feedback cancellation algorithms it is attempted to model the acoustic feedback path by an adaptive filter and then creating an estimate of the feedback signal. There are several methods to update the adaptive filter.

One commonly used method is to use the output signal (from a processing unit to a receiver) as reference signal and the residual signal after cancellation (of an input signal from a microphone) as the error signal, and use these signals together with an update method of the filter coefficients that minimizes the energy of the error signal, e.g. a least mean squared (LMS) algorithm. This arrangement is termed 'the direct method of closed loop identification' and illustrated in FIG. 4 in a hearing aid.

A benefit of the direct method is that the use of a probe noise signal in the reference signal is not necessary provided that the output signal is uncorrelated with the input signal. However, unfortunately in hearing aid applications the output and input signals are typically not uncorrelated, since the output signal is in fact a delayed (and processed) version of the input signal; consequently, autocorrelation in the input signal leads to correlation between the output signal and the input signal. If correlation exists between these two signals, the feedback cancellation filter will not only reduce the effect of feedback, but also remove components of the input signal, leading to signal distortions and a potential loss in intelligibility (in the case that the input signal is speech) and sound quality (in the case of audio input signals).

US 2007/0076910 A1 deals with a method of operating a hearing device system comprising first and second hearing devices located at opposite ears of a person, wherein the microphone signal of each hearing device is wirelessly transmitted to the other hearing device and processed there to reduce the risk of acoustic feedback from a receiver to a microphone of a given hearing device.

WO 99/43185 A1 deals with a binaural hearing aid system comprising first and second hearing devices located at opposite ears of a person, wherein the microphone signal of each hearing device is wirelessly transmitted to the other hearing device, and wherein each hearing aid device comprises signal processing means, which process the microphone signal from its own microphone as well as the microphone signal wirelessly received from the other hearing aid device.

DISCLOSURE OF INVENTION

An object of the present invention is to provide an alternative scheme for reducing the effect of acoustic feedback in a hearing aid system.

A new scheme for reducing the acoustic feedback is proposed in this invention by using inter-aural signal transmission and optionally binary gain patterns. The method requires two spatially separated listening devices, e.g. two hearing aids, e.g. one on each ear.

Objects of the invention are achieved by the invention described in the accompanying claims and as described in the following.

An object of the invention is achieved by a hearing aid system comprising first and second spatially separated hearing instruments, the system being adapted for processing input sounds to output sounds according to a user's needs and each comprising

- a first input transducer for converting a first input sound to a first electric input signal, and
- a first output transducer for converting a first processed electric output signal to a first output sound, the second hearing instrument comprising

- a second input transducer for converting a second input sound to a second electric input signal, and
- a second output transducer for converting a second processed electric output signal to a second output sound, the system being adapted to provide that a first Tx-signal originating from the first electric input signal of the first hearing instrument is transmitted to the second hearing instrument and used in the formation of the second processed electric output signal, and that a second Tx-signal originating from the second electric input signal of the second hearing instrument is transmitted to the first hearing instrument and used in the formation of the first processed electric output signal.

An advantage of the invention that it provides a scheme for reducing or effectively eliminating acoustic feedback in a pair of hearing instruments.

The term 'originating from the electric input signal' is in the present context taken to mean a signal based on or derived from (e.g. an attenuated or amplified version of) the electric input signal from the input transducer, e.g. an analog output signal from the input transducer, or a digitized version thereof (e.g. from an A/D-converter connected to the input transducer), or a processed version of the electric input signal, e.g. wherein directional information has been extracted or, ultimately, wherein the electric input signal has been processed in a digital signal processor and e.g. adapted to a users hearing profile (e.g. in the form of the processed output signal as forwarded to an output transducer). In general, the term 'signal-1 originating from signal-2' may indicate that signal-1 is based on or derived from (e.g. an attenuated or amplified otherwise modified version of) signal-2. The term 'signal-1 originating from signal-2' may indicate that the source of signal-1 (e.g. the output of a functional block or component)

is electrically connected to the destination of signal-2 (e.g. the input of a functional block or component). The term 'originating from' may indicate 'equal to' (e.g. that the signals are substantially identical).

The term 'used in the formation of' is here understood to mean e.g. 'added to' or subtracted from or 'multiplied by' or otherwise combined with the original signal to form the signal in question (e.g. including a further processing of the original signal). The term 'signal-1 is used in the formation of signal-2' may indicate that the source of signal-1 is electrically connected to the destination of signal-2. The term 'used in the formation of' may indicate 'equal to' (i.e. that the signals are identical).

The term 'hearing instruments' is in the present context taken to include hearing devices comprising a microphone, a frequency dependent gain of the microphone signal to be presented to a user by a receiver (speaker).

The term 'spatially separated' is taken to mean a certain physical distance apart, e.g. at least 0.1 m apart. In an embodiment, the first and second hearing instruments are 'spatially separated', if located on different parts of a person's body, e.g. one at an ear and another around the neck or at or in a pocket, or e.g. on each side of a head of a user, e.g. at or in the respective ears of the user. In an embodiment, the first (second) input transducer is spatially separated from the second (first) output transducer in that the distance between them, when the system is in operation, is larger than 0.05 m, such as in the range from 0.05 m to 0.2 m. In an embodiment, the first (second) input transducer is spatially separated from the second (first) output transducer in that the distance between them, when the system is in operation, is less than 1 m e.g. less than 0.5 m.

In a preferred embodiment, the first and/or second Tx-signals comprise the full audio frequency range considered by the hearing instrument, e.g. the frequency range between 20 Hz and 12 kHz. Alternatively, the first and/or second Tx-signals comprise a part of the full audio frequency range considered by the hearing instrument, such as e.g. one or more specific frequency ranges or bands, e.g. the relatively low frequency ranges (e.g. frequencies below 1 500 or 1000 Hz) or the relatively high frequency ranges (e.g. frequencies above 2000 or 4 000 Hz).

In a preferred embodiment, the first hearing instrument comprises a first signal processing unit (SPU-1) for processing a first SPU-1-input signal, for providing a first frequency dependent forward gain G-11, and for providing a corresponding processed G-11-output signal, and wherein the system is adapted to provide that the first SPU-1-input signal originates from the second Tx-signal (cf. e.g. FIGS. 5, 6). Thus the signal processed in the first hearing instrument has been picked up in the spatially separated second hearing instrument.

In a particular embodiment, the first signal processing unit (SPU-1) is adapted for processing a second SPU-1-input signal, for providing a second frequency dependent forward gain G-12, and for providing a corresponding processed G-12-output signal, and wherein the system is adapted to provide that the second SPU-1-input signal originates from the first electric input signal (cf. e.g. FIGS. 5, 6). This provides the option of processing an input signal originating from hearing instrument 2 as well as an input signal originating from hearing instrument 1. The resulting two processed G-11 and G-12 output signals can e.g. be further processed, e.g. compared or combined (cf. e.g. FIG. 6).

In a particular embodiment, the system is adapted to provide that the first Tx-signal is (essentially) equal to the first (preferably digitized) electric input signal provided by the first input transducer (cf. e.g. signal 1$^{st}$ Tx in FIG. 6).

In a particular embodiment, the second hearing instrument comprises a second signal processing unit (SPU-2) for processing a first SPU-2-input signal, providing a first frequency dependent forward gain G-21, and providing a corresponding processed G-21-output signal, and wherein the system is adapted to provide that the first SPU-2-input signal originates from the first Tx-signal (cf. e.g. FIGS. 5, 6). Thus the signal processed in the second hearing instrument has been picked up in the spatially separated first hearing instrument.

In a particular embodiment, the second signal processing unit (SPU-2) is adapted for processing a second SPU-2-input signal, for providing a second frequency dependent forward gain G-22, and for providing a corresponding processed G-22-output signal, and wherein the system is adapted to provide that the second SPU-2-input signal originates from the second electric input signal (cf. e.g. FIGS. 5, 6). This provides the option of processing an input signal originating from hearing instrument 1 as well as an input signal originating from hearing instrument 2. The resulting two processed G-21 and G-22 output signals can e.g. be further processed, e.g. compared or combined (cf. e.g. FIG. 6).

In a particular embodiment, the system is adapted to provide that the first processed electric output signal originates from the processed G-11-output signal (cf. G-11 out in FIGS. 5, 6). This has the advantage—in view of acoustic feedback—that the first output sound signal is based on an input sound signal picked up in a spatially separate location (namely in hearing instrument 2).

In a particular embodiment, the system is adapted to provide that the first processed electric output signal originates from a combination of the processed G-11-output signal and the processed G-12-output signal. This has the advantage that the first output sound signal can be composed of signals originating from either of or both hearing instruments, e.g. be based on the input sound signal of first hearing instrument in frequency ranges where acoustic feedback or the risk of having acoustic feedback is negligible and on the input sound signal of the second hearing instrument in frequency ranges where acoustic feedback or the risk of having acoustic feedback is substantial. Alternatively, the first output sound signal can be a (possibly weighted) sum of the two processed output signals (G-11, G-12 in FIG. 6).

In a particular embodiment, the system is adapted to provide that the second processed electric output signal originates from the processed G-21-output signal (cf. G-21 out in FIG. 6). This has the advantage—in view of acoustic feedback—that the second output sound signal is based on an input sound signal picked up in a spatially separate location (namely in hearing instrument 1).

In a particular embodiment, the system is adapted to provide that the second processed electric output signal originates from a combination of the processed G-21-output signal and the processed G-22-output signal. This has the advantage as outlined for the corresponding feature of the first processed electric output signal of the first hearing instrument.

In a particular embodiment, the system is adapted to provide that the first Tx-signal originates from the processed G-12-output signal. In an embodiment, the first Tx-signal is electrically connected to the second output transducer. In an embodiment, the processed G-12-output signal is equal to the second processed electric output signal. In a particular embodiment, the system is adapted to provide that the second processed electric output signal is equal to the first Tx-signal. This has the advantage that the second hearing instrument can be implemented as a somewhat simpler device, e.g. without signal processing (cf. e.g. the embodiment of FIG. 5).

In a 'normal' single hearing instrument, the criterion for avoiding feedback oscillation is that loop gain $LG=|H(f)\cdot G(f)|<1$ for all frequencies f in the frequency range considered, where H is the acoustic transfer function and G is the forward transfer function of the hearing instrument and f is frequency (or alternatively, when assuming logarithmic expressions of feedback gain (FBG) and forward gain (FwG), LG [dB]= FBG+FwG<0).

In an embodiment, the electrical input signal is analyzed in the frequency domain, i.e. the signal path comprises a time to frequency (t→f) converting unit, e.g. in the form of a filter bank or a Fourier transformation unit, or any other appropriate t→f conversion unit. Preferably, the electrical input signal is transformed into a digital signal by a sampling unit sampling an analog electric input signal at a predefined sampling frequency ($f_s$). Preferably, the digitized electric input signal is arranged in frames comprising a number ($N_s$) of digitized values of the electric input signal representing the signal in a predefined time ($N_s/f_s$).

The term 'frequency dependent gain' indicates a gain G(f) that has a functional dependence of frequency f. This functional dependence can in principle be represented by any continuous or discontinuous function, and may be constant over one or more partial frequency ranges of the total frequency range considered. In practice, the frequency range $\Delta f=[f_{min}; f_{max}]$ considered by a single hearing instrument or a hearing aid system is limited to the normal audible frequency range for a human being, e.g. 20 Hz≤f≤20 kHz (or typically with a lower upper limit, such as 8 kHz or 12 kHz), is often divided into a number N of frequency bands (FB), ($FB_1$, $FB_2, \ldots, FB_N$), e.g. N=16, and loop gain is expressed for each frequency band as $LG_i(f)=FBG_i(f)+FwG_i(f)$, for all frequencies f in the $i^{th}$ frequency band, i=1, 2, . . . , N. Preferably, the maximum value of loop gain $LG_{i,max}=(FwG_i+FBG_i)_{max}$ in each band is used, i=1, 2, . . . , N. The number of frequency bands N may take on any appropriate value adapted to the application in question. The frequency bands may be of equal width in frequency or of varying width.

In an embodiment of the invention, the system is adapted to provide that loop gain is smaller than one, i.e. $LG=|H_1(f)\cdot G_2(f)\cdot H_2(f)\cdot G_1(f)|<1$ for all frequencies f in the normal human audible frequency range considered by the system, $f_{min}\leq f\leq f_{max}$, where $f_{min}$ is e.g. 20 Hz and $f_{max}$ is e.g. 12 kHz, where $H_k$ is the acoustic feedback transfer function and $G_k$ is the forward transfer function of hearing instrument k (k=1, 2). In an embodiment, the system is adapted to provide that loop gain is smaller than one in at least one (e.g. the $q^{th}$) of the frequency bands $FB_i$ considered by the system, i=1, 2, . . . , N, i.e. $LG_q(f)=|H_1(f)\cdot G_2(f)\cdot H_2(f)\cdot G_1(f)|<1$, for all frequencies f in the $q^{th}$ frequency band (i.e. implying that $LG_{q,max}<1$). In an embodiment, the system is adapted to determine the frequency band or bands most likely to produce feedback oscillation. In an embodiment, the system is adapted to dynamically determine the frequency band or bands most likely to produce feedback oscillation. In an embodiment, the system is adapted to in advance of its use (e.g. during a fitting process) determine the frequency band or bands most likely to produce feedback oscillation. In an embodiment, the system is adapted to provide that $LG_q(f)=|H_1(f)\cdot G_2(f)\cdot H_2(f)\cdot G_1(f)|<1$, for all frequencies f in the frequency band or bands detected to be most likely to produce feedback oscillation (here the $q^{th}$ band). A dynamic determination of the frequency band or bands most likely to produce feedback oscillation can e.g. be based on the forward gain $FwG_{req}(FB_q)(t_n)$ requested at a given time $t_n$ by a signal processor of the forward path (based on the user's needs and the current level of the input signal in the frequency band in question, possibly taking a preset compression scheme into account), estimated feedback gain $FBG_{est}(FB_q)(t_n)$ (e.g. using an electric feedback loop with an adaptive filter) in comparison with predetermined (pd) maximum loop gain values $LG_{max}(FB_q)(pd)$ for the frequency band in question.

In an embodiment of the invention, the system is adapted to provide a time frequency map of the processed output signal. In an embodiment, the system is adapted to base gain manipulations of individual frequency bands on a time frequency map of a signal representative of the input signal. In a particular embodiment, a time-frequency tile of a signal representative of the input signal at a particular time instant $t_n$ is exchanged between the first and second hearing instruments. In a particular embodiment, a part of a tile comprising one or more selected frequency bands at a particular time instant $t_n$ is exchanged between the first and second hearing instruments. In an embodiment, the system is adapted to change the exchange strategy over time in dependence of one or more of e.g. the input signal, the forward gain, loop gain, etc. Exchanged between the first and second hearing instruments (HI) is taken to mean that the frame or part of the frame in question of $HI_1$, is copied to $HI_2$ and the corresponding (original) frame or part of the frame in question of $HI_2$ is copied to $HI_1$. Various aspects of time frequency mapping are e.g. discussed in P. P. Vaidyanathan, Multirate Systems and Filter Banks, Prentice Hall Signal Processing Series, 1993.

In a particular embodiment, the transmission between the first and second hearing instrument is based on wired transmission or wireless transmission, such as based on inductive coupling (near field) or radiated fields.

In a particular embodiment, the hearing aid system is adapted to preserve the directional cues of the input sound signals to the first and second hearing instruments. The term 'directional cues' is in the present context taken to refer to the interaural time and/or level differences, etc., as experienced by a normally hearing person when perceiving a sound. This has the advantage of avoiding the confusion of the brain of the user. This can e.g. be achieved by adapting the system to utilize a prerecorded tabulation of the transfer functions from left-to-right and from right-to-left ear, $H_{LR}(\omega,\alpha)$ and $H_{RL}(\omega,\alpha)$, respectively, to preserve the directional cues of the input sound signals to the first and second hearing instruments. In a particular embodiment, the hearing aid system is further adapted to tabulate the acoustic feedback transfer functions $H_{LR}(\omega,\alpha)$ and/or $H_{RL}(\omega,\alpha)$ for different directions of arrival $\alpha$ of the target signal, where $\alpha$ is the angle of incidence of the target acoustic signal in the horizontal plane. In a particular embodiment, the hearing aid system is adapted to tabulate the acoustic feedback transfer functions $H_{LR}(\omega,\phi)$ and/or $H_{RL}(\omega,\phi)$ for different directions of arrival $\phi$ of the target signal, where $\phi$ is the angle of elevation relative to a horizontal plane of the target acoustic signal. In general, the hearing aid system is adapted to compensate directional cues via $H_{LR}(\omega,\alpha,\phi)$ for the left ear, and via $H_{LR}(\omega,\alpha,\phi)$ for the right ear. In a particular embodiment, the hearing aid system is adapted to compensate directional cues by convolving the signal picked up from a given angle in the left ear with the impulse response corresponding to $H_{LR}(\omega,\alpha,\phi)$, e.g. the inverse Fourier transform of $H_{LR}(\omega,\alpha,\phi)$, and vice-versa for the right ear. Reference is made to a spherical coordinate system having a horizontal plane parallel to the ground and through the ears of the person in question when standing on the ground. $\alpha$ is an angle to the sound source with a direction in the horizontal plane defined by the nose of the person and $\phi$ is the angle to the sound source with the horizontal plane.

In a particular embodiment, the hearing aid system is adapted to provide that the forward gains $G_{i1}$ and $G_{i2}$ of at least some, e.g. a majority or all, of the frequency bands $FB_{i1}$ and $FB_{i2}$ of the first and second hearing instruments, respectively, are complementary to each other (i=1, 2, . . . , N).

The term 'complementary to each other' in relation to the forward gains of two frequency (sub-) bands is in the present context taken to mean that one is larger than the other, e.g. one is at least twice the other, such as at least 10 times the other, such as at least 100 times the other to ensure that when one is relatively large, the other is relatively small. When referring to the preferred embodiments, the term that $G_1$ and $G_2$ are 'complementary to each other' is taken to mean that $|G_1 \cdot G_2| < 1/|H_1 \cdot H_2|$. In an embodiment, $|G_1 \cdot G_2| < 0.1$, such as $|G_1 \cdot G_2| < 0.05$, such as $|G_1 \cdot G_2| < 0.01$, such as $|G_1 \cdot G_2| < 0.005$. $G_1$ and $G_2$ are the forward transfer functions and $H_1$ and $H_2$ are the acoustic transfer functions for the first (index 1) and second (index 2) hearing instruments, respectively. In an embodiment, the above mentioned relations for the product of the forward transfer functions are fulfilled on a band by band basis $|G_{i1} \cdot G_{i2}| < 0.1$, etc., i=1, 2, . . . , N. In an embodiment, the above mentioned relations are fulfilled for at least one band, such as a majority or all of the bands of the frequency range considered by the hearing aid system. In an embodiment, the above mentioned relations are checked and/or fulfilled only for the frequency band or bands most likely to produce feedback oscillation.

In a particular embodiment, the hearing aid system is adapted to provide that a sub-range $SB_{i1j}$ of a given frequency band $FB_{i1}$ of the first hearing instrument is set to a relatively low value $G_{low,i1j}$ and the corresponding sub-range $SB_{i2j}$ of the corresponding frequency band $FB_{i2}$ of the second hearing instrument is set to a relatively high value $G_{high,i2j}$, or vice versa.

The terms relatively low and relatively high are in the present context taken to mean that the relatively high value is larger than the relatively low value, e.g. that the relatively high value is at least twice the relatively low value, such as at least 10 times the relatively low value, such as at least 100 times the relatively low value.

In a particular embodiment, the hearing aid system is adapted to provide that a sub-range $SB_{i1j}$ of a given frequency band $FB_{i1}$ of the first hearing instrument is set to a relatively low value $G_{low,i1j}$ and a neighboring sub-range $SB_{i1(j+1)}$ of the same frequency band $FB_{i1}$ of the first hearing instrument is set to a relatively high value $G_{high,i1(j+1)}$ AND that the corresponding sub-range $SB_{i2j}$ of the corresponding frequency band $FB_{i2}$ of the second hearing instrument is set to a relatively high value $G_{high,i2j}$ and a neighboring sub-range $SB_{i2(j+1)}$ of the same frequency band $FB_{i2}$ of the second hearing instrument is set to a relatively low value $G_{low,i2(j+1)}$, or vice versa. Thus, the loop gain at any frequency of that band is kept low and feedback instability is reduced, such as substantially avoided.

In a particular embodiment, the hearing aid system is adapted to provide that a relatively low value $G_{low,i1j}$, $G_{low,i2(j+1)}$ of the forward gain of a frequency band $FB_{i1}$, $FB_{i2}$ of a first and second hearing instrument, respectively, is set to ideally zero (i.e. as close as physically possible). Thus, the loop gain at any frequency of that band is kept close to 0 and feedback instability is avoided.

In a particular embodiment, the hearing aid system is adapted to provide that a majority of, such as all frequency bands, i=1, 2, . . . , N, comply with the complementary forward gain scheme outlined above.

In general, one or more of the frequency bands $FB_{i1}$, $FB_{i2}$ (i=1, 2, . . . , N) of the first and second hearing instruments, respectively, can be subdivided in $M_i$ sub-bands $SB_{i1j}$, $SB_{i2j}$, respectively, (j=1, 2, . . . , $M_i$). In an embodiment, one or more corresponding frequency bands $FB_{i1}$, $FB_{i2}$ have alternating relatively high and relatively low gain values in their sub-bands $SB_{i1j}$, $SB_{i2j}$ (j=1, 2, . . . , $M_i$) in such a way that if $SB_{i11}$ is relatively low, $SB_{i21}$ is relatively high and vice versa.

In a particular embodiment, the hearing aid system is adapted to provide that one or more (e.g. a majority or all of the) corresponding frequency bands $FB_{i1}$, $FB_{i2}$ of the first and second hearing instruments each comprise two sub-bands, $SB_{i11}$, $SB_{i12}$ and $SB_{i21}$, $SB_{i22}$, respectively, e.g. each constituting half of the frequency range of that band.

In a particular embodiment, the hearing aid system is adapted to provide that the frequency ranges of at least some of, preferably a majority of, such as all of the frequency bands $FB_{i1}$, $FB_{i2}$ of the first and second hearing instruments are arranged according to critical bands as defined by auditory perception theory (i=1, 2, . . . , N), see e.g. B. C. J. Moore, 'An Introduction to the Psychology of Hearing', Elsevier Academic Press, 2004, Chapter 3. By ensuring that both high and low gain values occur within each critical band (see e.g. FIG. 3, wherein the vertical dashed lines indicate limits of critical bands, each critical band $FB_{i1}$, $FB_{i2}$ (i=1, 2, . . . , N) of hearing instrument 1 and 2, respectively, being split in (here) two subbands $SB_{i11}$, $SB_{i12}$, and $SB_{i21}$, $SB_{i22}$, respectively), one can ensure that a given desired signal power is present within each critical band while still avoiding feedback problems. We exploit here the observation that according to very crude models of the auditory system, the exact distribution of energy within each critical band is less important for perceptual quality, as long as the total amount of energy within each critical band is correct. By doing so, potential negative perceptual consequences (e.g. loss of the ability to locate a given sound source and sound quality degradations) of this aggressive gain strategy are reduced.

In a particular embodiment, each hearing instrument of the hearing aid system comprises a feedback cancellation system comprising a feedback path estimation unit, e.g. comprising an adaptive filter.

A method of reducing acoustic feedback in a hearing aid system comprising first and second hearing instruments, the system being adapted for processing input sounds to output sounds according to a user's needs is furthermore provided by the present invention, the method comprising in said first and second hearing instruments providing that an input sound is converted to first and second electric input signal, respectively;

providing that first and second processed electric output signals, respectively, are converted to an output sound, and providing that a first Tx-signal originating from the first electric input signal of the first hearing instrument is transmitted to the second hearing instrument and used in the formation of the second processed electric output signal and that a second Tx-signal originating from the second electric input signal of the second hearing instrument is transmitted to the first hearing instrument and used in the formation of the first processed electric output signal.

It is intended that the structural features of the system described above, in the detailed description of 'mode(s) for carrying out the invention' and in the claims can be combined with the method, when appropriately substituted by corresponding process features. Embodiments of the method have the same advantages as the corresponding systems.

At least some of the features of the system and method described above may be implemented in software and carried out fully or partially on a signal processing unit of a hearing aid system caused by the execution of signal processor-executable instructions. The instructions may be program code means loaded in a memory, such as a RAM, or ROM located in a hearing instrument or another device via a (possibly wireless) network or link. Alternatively, the described features may be implemented by hardware instead of software or by hardware in combination with software.

Use of a hearing aid system as described above, in the detailed description and in the claims is moreover provided by the present invention.

In a further aspect, a software program for running on a signal processor of a hearing aid system is moreover provided by the present invention. When the software program implementing at least some of the steps of the method described above, in the detailed description of 'mode(s) for carrying out the invention' and in the claims, is executed on the signal processor, a solution specifically suited for a digital hearing aid is provided.

In a further aspect, a medium having instructions stored thereon is moreover provided by the present invention. The instructions, when executed, cause a signal processor of a hearing aid system as described above, in the detailed description of 'mode(s) for carrying out the invention' and in the claims to perform at least some of the steps of the method described above, in the detailed description of 'mode(s) for carrying out the invention' and in the claims.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Figure 4:
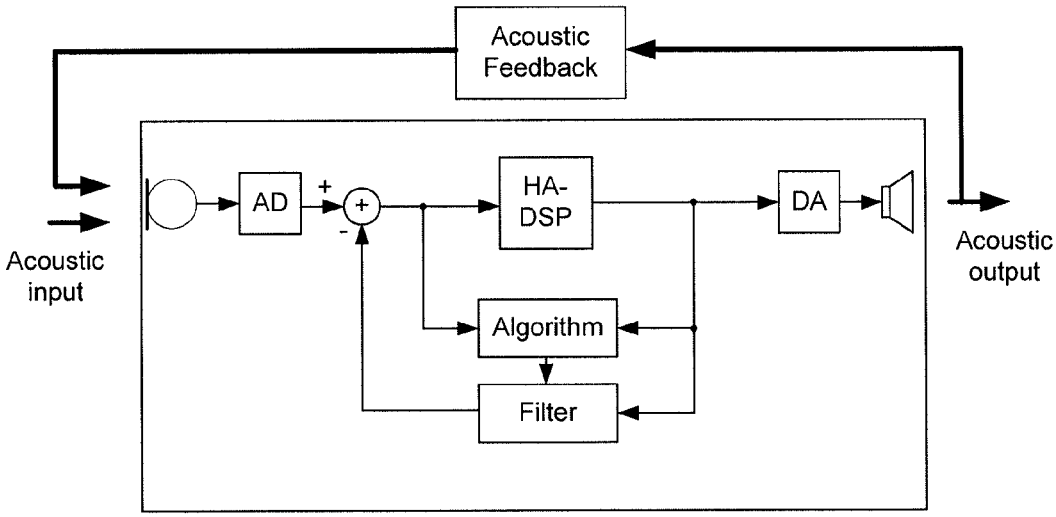
FIG. 4 shows a schematic representation of a (prior art) hearing aid comprising a signal path and a feedback cancellation path, the latter comprising an adaptive filter.

FIG. 4 shows a simplified block diagram of a hearing aid comprising a conventional feedback cancellation system for reducing or cancelling acoustic feedback from an 'external' feedback path (termed 'Acoustic Feedback' in FIG. 4) from an output to an input transducer of the hearing aid. The feedback cancellation system comprises an adaptive filter, which is controlled by a prediction error algorithm, e.g. an LMS (Least Means Squared) algorithm, in order to predict and cancel the part of the microphone signal that is caused by feedback from the receiver of the hearing aid. The adaptive filter (in FIG. 4 comprising a 'Filter' part end a prediction error 'Algorithm' part) is aimed at providing a good estimate of the 'external' feedback path from the digital to analogue converter DA to the analogue to digital converter AD. The prediction error algorithm uses a reference signal together with the (feedback corrected) microphone signal to find the setting of the adaptive filter that minimizes the prediction error when the reference signal is applied to the adaptive filter. The forward path (alternatively termed 'signal path') between input transducer (microphone) and output transducer (receiver) of the hearing aid comprises a signal processing unit ('HA-DSP' in FIG. 4) to adjust the signal to the impaired hearing of the user.

Figure 1:
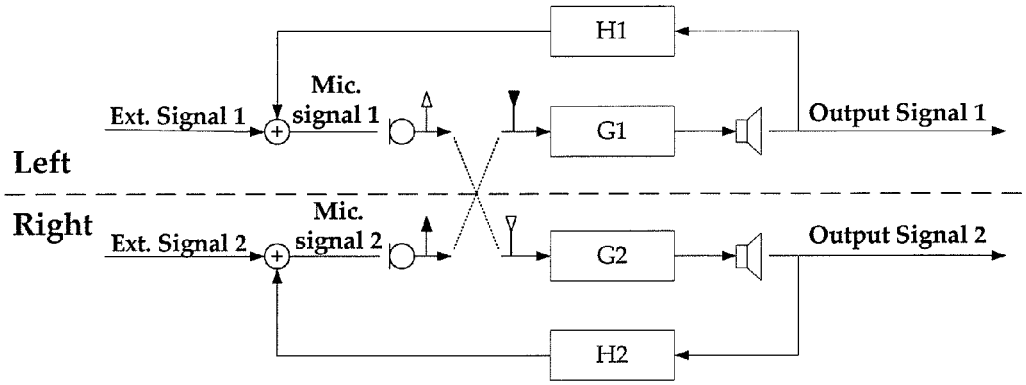
FIG. 1 shows the proposed system setup. The microphone signals from each hearing instrument are re-routed to the opposite side. $|G_1|(|G_2|)$ and $|H_1|(|H_2|)$ are the frequency dependent forward gains and feedback gains, respectively, of the left(right) hearing instrument.

FIG. 1 shows an embodiment of a hearing aid system according to the invention. The system comprises first and second hearing instruments of a binaural system, where the first and second hearing instruments are adapted to communicate either by wire or a wireless link. The microphone signals from each hearing instrument are re-routed to the opposite side. $|G_1|(|G_2|)$ and $|H_1|(|H_2|)$ are the frequency dependent forward gains and feedback gains, respectively, of the left(right) hearing instrument.

In the system shown in FIG. 1, the microphone signal from the hearing instrument on one side (of the head) is re-routed to the hearing instrument on the other side by an inductive (near-field) wireless link. Alternatively, the wireless link could be based on radiated fields and/or governed by a standardized transmission protocol, e.g. Bluetooth.

Proper signal processing is preferably conducted in order to preserve the location cues of the external sound signal. Alternatively, the user must learn to compensate.

Figure 2A:
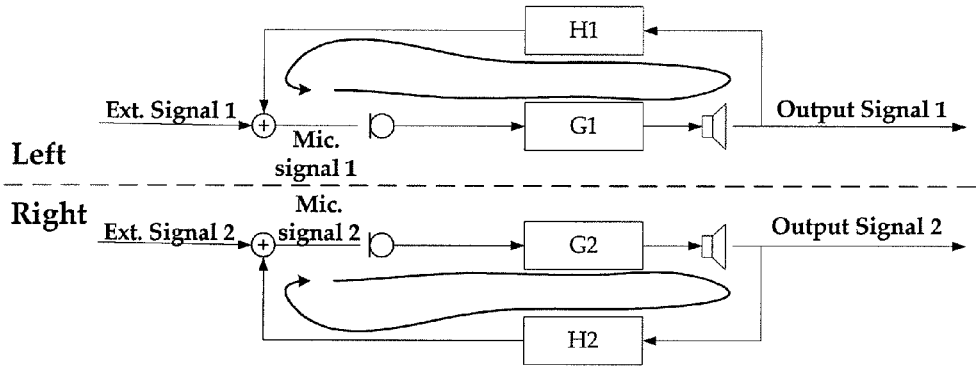
FIG. 2 shows a prior art, traditional binaural hearing aid system (FIG. 2*a*) and embodiments of a hearing aid system according to the invention (FIGS. 2*b*, 2*c*, 2*d*), FIG. 3 schematically shows exemplary (idealized) corresponding values of forward gains $|G_1|$ and $|G_2|$ for different frequency bands of an embodiment of a hearing aid system according to the invention.

Although, in principle, three feedback loops prevail in embodiments of the invention, two of the loops are, however, typically negligible, cf. FIG. 2*d* and discussion below. Compared to the traditional setups, there is,—under preferred practical circumstances—only one loop instead of two separate loops as shown in the prior art system of FIG. 2*a*.

The embodiment shown in FIG. 1 is adapted to provide that loop gain (LG) is smaller than one in at least one (preferably a majority or all) of the frequency bands $FB_i$ (e.g. the $k^{th}$) considered by the system, i=1, 2, . . . , N, i.e. $LG(FB_k)=|H_1(FB_k)\cdot G_2(FB_k)\cdot H_2(FB_k)\cdot G_1(FB_k)|<1$, for all frequencies f in the $k^{th}$ frequency band, where $|H_i|$ is the acoustic feedback gain and $|G_i|$ is the forward gain of hearing instrument i (i=1, 2). Preferably, the system is adapted to determine the frequency band or bands most likely to produce feedback oscillation (here assumed to be $FB_k$). Alternatively, the system is adapted to provide that the relation $LG=|H_1\cdot G_2\cdot H_2\cdot G_1|<1$ is fulfilled for all frequencies f of selected bands (e.g. with a predefined high probability of experiencing feedback oscillation, e.g. based on empirical data), such as of a majority of the bands, e.g. all of the bands considered by the system.

Figure 2B:
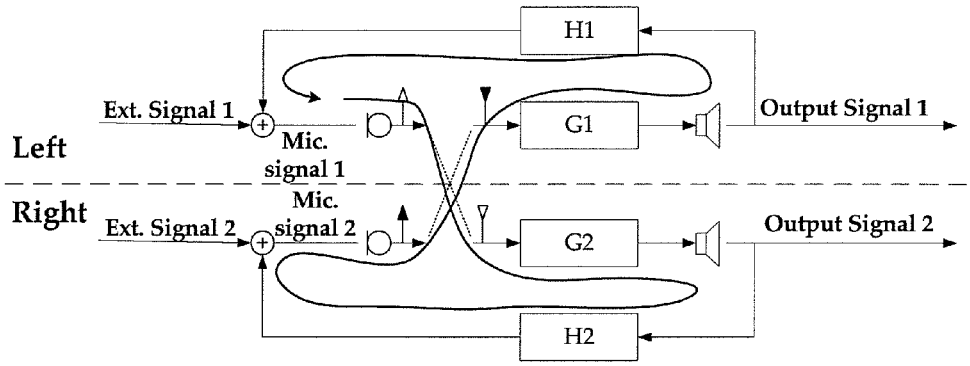
Figure 2C:
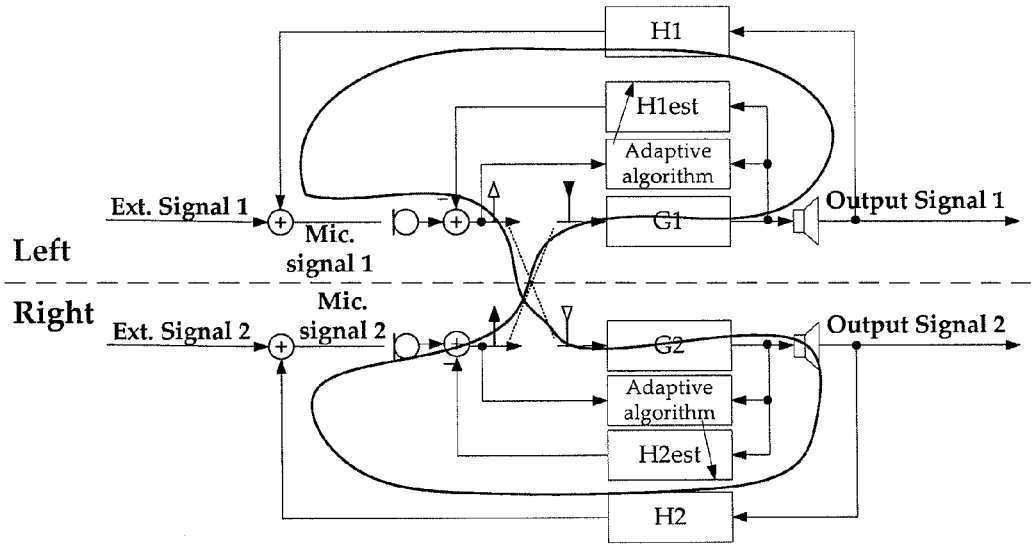
Figure 2D:
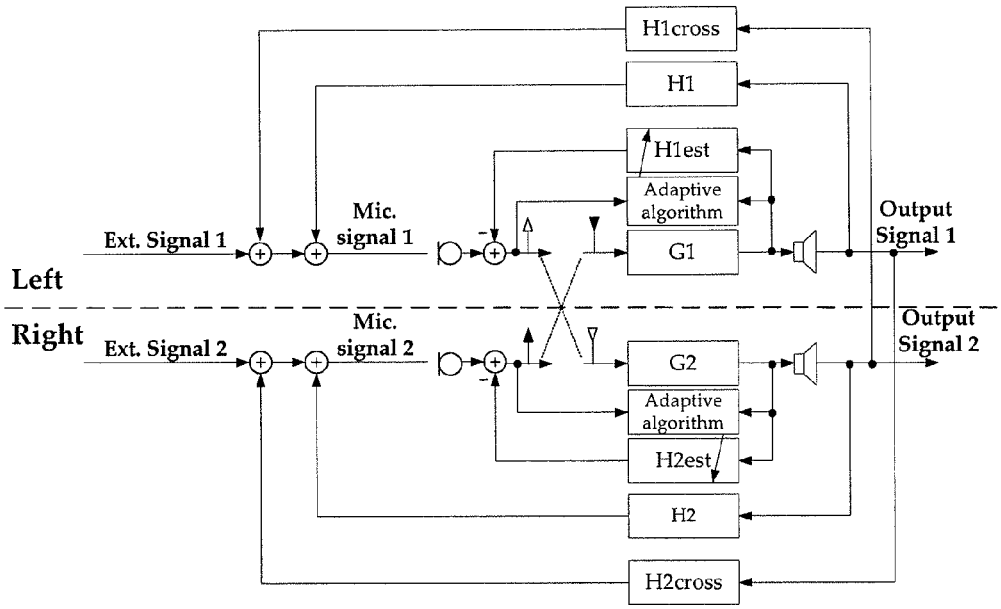

FIG. 2 shows a prior art, traditional binaural hearing aid system (FIG. 2*a*) and embodiments of a hearing aid system according to the invention (FIGS. 2*b*, 2*c*, 2*d*). In the system shown in FIG. 2*b* (corresponding to the system of FIG. 1), there is only one signal loop compared to the traditional systems shown in FIG. 2*a*, where each of the two hearing instruments has its own forward path→feedback loop. FIG. 2*c* shows an embodiment of the proposed system with an adaptive feedback cancellation system. In principle, an acoustical coupling exists between the output signal in the left-ear loudspeaker and the right-ear microphone, and vice versa. In an embodiment, this coupling is neglected. The coupling is, however, preferably taken into account by extending FIG. 2*c* to a system as illustrated in FIG. 2*d*. Here, transfer functions $H_{1cross}$ and $H_{2cross}$ have been included to model this acoustic (cross-) coupling. In principle, it is possible to include additional adaptive filters to compensate for this coupling, as well. In most situations, however, the impact of the coupling will be negligible. Setting $H_{1cross}=H_{2cross}=0$ in FIG. 2*d* leads to the embodiment in FIG. 2*c*. However, in cases where the gain applied in a particular frequency range in one of the hearing aids is high, it may be advantageous to take the coupling into account.

Because of the single loop in the proposed system, it is possible to manipulate frequency dependent forward gains $G_1$ and $G_2$ in such way that the loop gain at any frequency is always smaller than 1. One (theoretically) possible way to define forward gains $G_1$ and $G_2$ is shown in FIG. 3.

Figure 3:
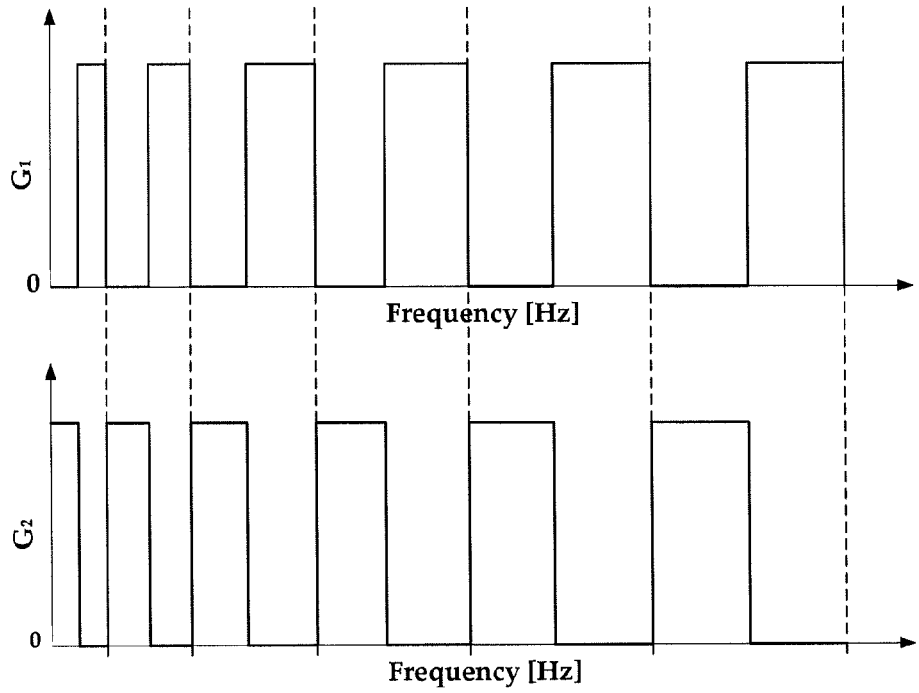

FIG. 3 schematically shows exemplary (idealized) corresponding values of forward gains |G1| and |G2| for different frequency bands of an embodiment of a hearing aid system according to the invention.

Preferably, the vertical dotted lines separate the critical bands (cf. e.g. B. C. J. Moore, An Introduction to the Psychology of Hearing, Elsevier, $5^{th}$ edition, 2006, ISBN-13: 978-0-12-505628-1, Chapter 3, pp. 65-126). In each half of critical bands known from auditory perception theory, the forward gain $G_1$ of the first hearing instrument is set to 0 (or a small value) and in the other half of the same critical band, the forward gains $G_2$ of the second hearing instrument is set to 0 (or a small value). Thus, the loop gain at any frequencies is kept close to 0 and the feedback instability is avoided.

The applied gain in each half of a critical band may be arbitrary high if a zero gain is applied in the same half at the opposite hearing instrument. The applied non-zero gain level in each half of a critical band should preferably be adjusted in such a way that the output sound signal has the desired perceptual loudness level. Any other gain pattern than binary can also be used (with reduced performance). In FIG. 3, the idealized gain variation with frequency (band) is shown to take the form of rectangular pulses. In reality, the gain variation may take other forms, e.g. the pulses may have a smooth, e.g. bell-shaped or Gaussian or triangular or any other practically appropriate form providing that signal power present within each critical band s below a predetermined level to avoiding or minimize feedback problems, while still providing a suitable gain in the frequency range in question.

Due to the proposed re-routing of signals, the direction cues experienced by the listener may be disturbed: Sounds, which would normally be perceived as coming from the left, will be perceived as coming from the right, and vice versa. Although the user may in fact be able to get used to this (in that the user's brain adapts and makes an appropriate correction), given sufficiently long time, a compensation for this disturbance of the sound image using signal processing is preferable.

More specifically, for a given user, transfer functions from left-to-right and right-to-left ear, $H_{LR}(\omega,\alpha)$ and $H_{RL}(\omega,\alpha)$, respectively, can be tabulated a priori. Preferably, these functions should be tabulated for different directions of arrival $\alpha$ of the target signal (for simplicity, we consider only angles in the horizontal plane. It is straight-forward, though, to generalize the discussion to include elevation as well), but in principle the transfer functions could be tabulated as functions of other parameters too; these ear-to-ear transfer functions could for example be derived from measurements of head related transfer functions for various angles of incidence. We also assume that the angle of arrival $\alpha$ of a target sound at a given time instant is known. This angle may be found as the output of a standard directional algorithm, cf. e.g. Elko et al., A simple adaptive first-order differential microphone, IEEE ASSP Workshop on Applications of Signal Processing to Audio and Acoustics, 1995, 15-18 Oct. 1995, pp. 169-172.

At run-time (i.e. when the system is in ordinary use), compensation can simply be performed by convolving the signal picked up from a given angle $\alpha$ in the left ear with the impulse response corresponding to $H_{LR}(\omega,\alpha)$ (i.e., the inverse Fourier transform of $H_{LR}(\omega,\alpha)$) and vice-versa for the right ear.

Figure 5:
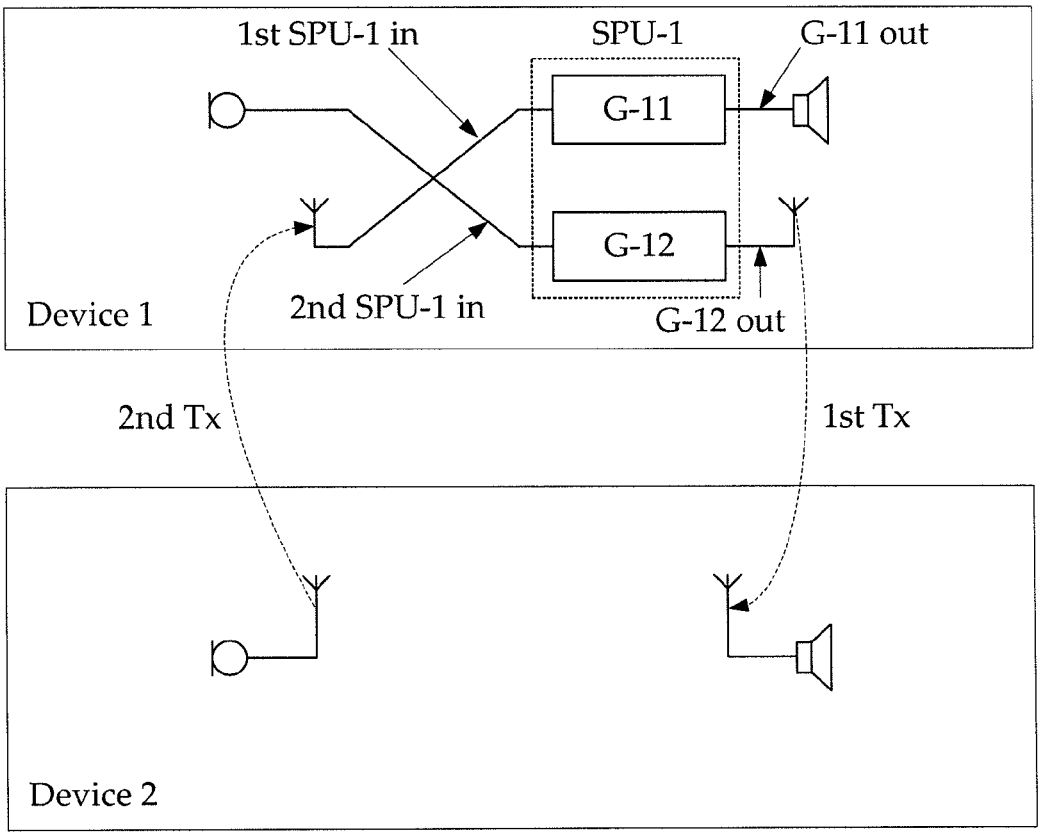
FIG. 5 shows an embodiment of a hearing aid system according to the invention, wherein one hearing instrument provides processing for both hearing instruments.

FIG. 5 shows an embodiment of a hearing aid system according to the invention, wherein one hearing instrument provides processing for both hearing instruments. In the embodiment of FIG. 5, the first hearing instrument comprises a first microphone, a signal processing unit (SPU-1) and a first receiver. The second hearing instrument comprises a second microphone and a second receiver. Both hearing instruments further comprise a wireless transceiver for establishing a wireless link between the two hearing instruments. The wireless transceivers each comprise an antenna, a receiver and a transmitter. The wireless transceiver of the first hearing instrument is adapted for transmitting a first Tx-signal ($1^{st}$ Tx) to the second hearing instrument, and for receiving a second Tx-signal ($2^{nd}$ Tx) from the second hearing instrument. Correspondingly, the wireless transceiver of the second hearing instrument is adapted for transmitting a second Tx-signal to the first hearing instrument, and for receiving a first Tx-signal from the first hearing instrument. The electrical input signal from the (second) microphone of the second hearing instrument (which picks up a sound at the second hearing instrument) is wirelessly transmitted to the first hearing instrument (via the respective transceivers) and electrically connected to a first input of the first signal processing unit SPU-1 (input $1^{st}$ SPU-1 in). The first signal processing unit SPU-1 provides a first processed output signal (G-11 out) yielding a frequency dependent gain G-11(*f*) to the first input signal ($1^{st}$ SPU-1 in). The first processed output signal (G-11 out) is electrically connected to the (first) output transducer for presenting a (first) output sound to the user. The electrical input signal from the (first) microphone of the first hearing instrument (which picks up a sound at the first hearing instrument) is fed to a second input of the first signal processing unit SPU-1 (input $2^{nd}$ SPU-1 in). The first signal processing unit SPU-1 provides a second processed output signal (G-12 out) yielding a frequency dependent gain G-12(*f*) to the second input signal ($2^{nd}$ SPU-1 in). The second processed output signal (G-12 out) is wirelessly transmitted to the second hearing instrument (via the respective transceivers) and electrically connected to the (second) output transducer for presenting a (second) output sound to the user. The system of FIG. 5 has the advantage that the total feedback transfer function is reduced compared to a normal system. Further, by restricting the major part of the signal processing to one of the hearing instruments, the synchronization of gain transfer functions (cf. e.g. FIG. 3 and corresponding description) will be more straight forward because the exchange of processing parameters (e.g. gain values) can be performed without wireless transmission. It further makes the second instrument simpler and cheaper to manufacture. If an AFB-system is included, it has the further advantage of reducing the correlation between the input and output signals.

Figure 6:
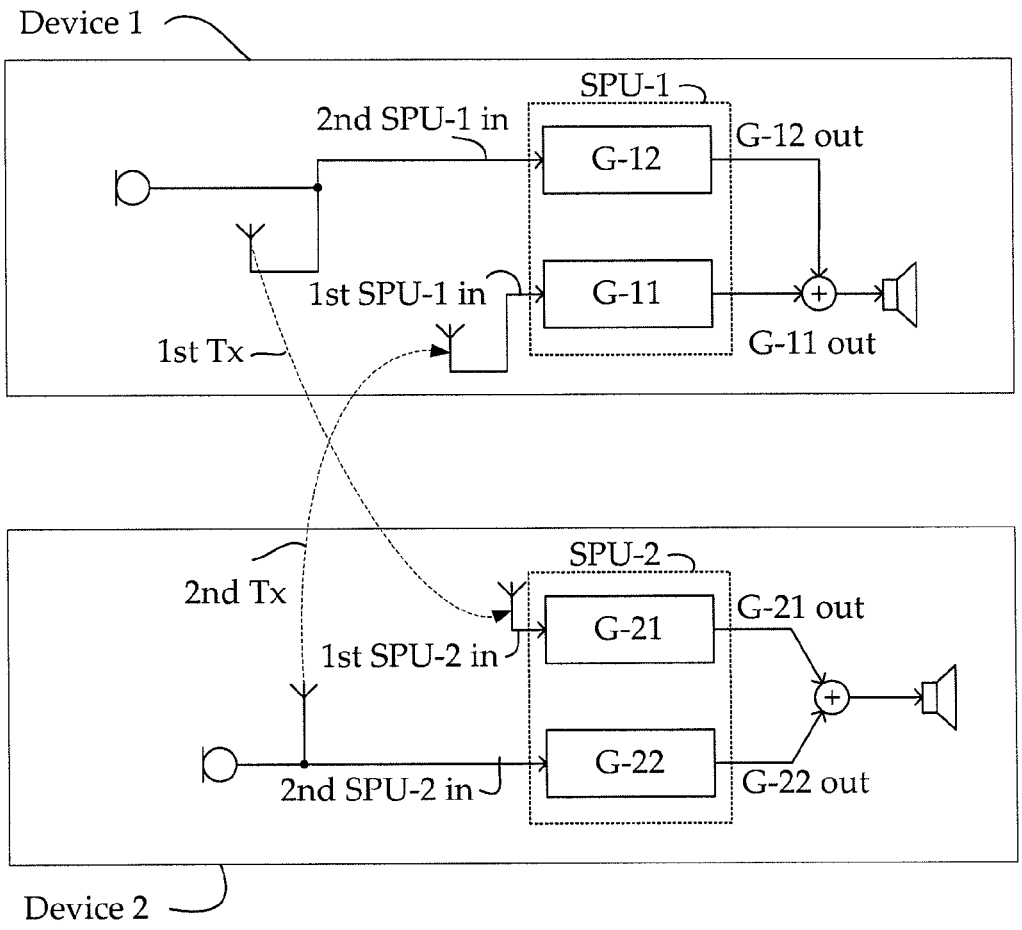
FIG. 6 shows an embodiment of a hearing aid system according to the invention, wherein processing in each hearing instrument is based on a microphone signal from both hearing instruments.

FIG. 6 shows an embodiment of a hearing aid system according to the invention, wherein processing in each hearing instrument is based on a microphone signal from both hearing instruments. FIG. 6 shows an embodiment of a hearing aid system according to the invention, wherein both hearing instrument provides processing based on input signals from both hearing instruments. In the embodiment of FIG. 6, the first and second hearing instrument each comprises a microphone, a signal processing unit (SPU-1, SPU-2, respectively, in FIG. 6), a receiver and a wireless transceiver for establishing a wireless link between the two hearing instruments. The wireless transceivers operate as explained above in connection with FIG. 5. The electrical input signal from the (second) microphone of the second hearing instrument (which picks up a sound at the second hearing instrument) is wirelessly transmitted (signal $2^{nd}$ Tx in FIG. 6) to the first hearing instrument (via the respective transceivers) and electrically connected to a first input of the first signal processing unit SPU-1 (input $1^{st}$ SPU-1 in). The first signal processing unit SPU-1 provides a first processed output signal (G-11 out) yielding a frequency dependent gain G-11(*f*) to the first input signal ($1^{st}$ SPU-1 in). The electrical input signal from the (first) microphone of the first hearing instrument (which picks up a sound at the first hearing instrument) is fed to a second input of the first signal processing unit SPU-1 (input $2^{nd}$ SPU-1 in). The first signal processing unit SPU-1 provides a second processed output signal (G-12 out) yielding a frequency dependent gain G-12(*f*) to the second input signal ($2^{nd}$ SPU-1 in). The first (G-11 out) and second (G-12 out) processed output signals from the first signal processing unit SPU-1 are electrically connected to a combination unit (here summation unit (+ in FIG. 6)), whose combination output is fed to the (first) receiver of the first hearing instrument for presenting a (first) output sound to the user. The second hearing instrument is arranged correspondingly, in that the first input of the second signal processing unit SPU-2 (input $1^{st}$ SPU-2 in) originates from the electrical input signal from the (first) microphone of the first hearing instrument (which picks up a sound at the first hearing instrument). The electrical input signal from the (first) microphone is wirelessly transmitted (signal $1^{st}$ Tx in FIG. 6) to the second hearing instrument (via the respective transceivers) and electrically connected to the first input of the second signal processing unit SPU-2. The other connections and components correspond to those described for the first hearing instrument. An advantage of this embodiment is that the total feedback transfer function is reduced compared to a normal system. Further, the first and second output sound signals can each be composed of signals originating from either of or both hearing instruments, so that the output signals can be dynamically (i.e. over time) optimized according to the current target signal and/or feedback conditions, possibly by applying different weights to the two input signals to the combination unit at different times and/or in different frequency ranges.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims. For example, the illustrated embodiments are shown to contain a single microphone. Other embodiments may contain a microphone system comprising two or more microphones, and possibly including means for extracting directional information from the signals picked up by the two or more microphones.

REFERENCES

- € US 2007/0076910 A1 (SIEMENS AUDIOLOGISCHE TECHNIK) May 4, 2007
- € WO 99/43185 A1 (TØPHOLM & WESTERMANN) 26 Aug. 1999
- € P. P. Vaidyanathan, Multirate Systems and Filter Banks, Prentice Hall Signal Processing Series, 1993.
- € B. C. J. Moore, An Introduction to the Psychology of Hearing, Elsevier, $5^{th}$ edition, 2006, ISBN-13: 978-0-12-505628-1
- € Elko, G. W. and Anh-Tho Nguyen Pong, A simple adaptive first-order differential microphone, IEEE ASSP Workshop on Applications of Signal Processing to Audio and Acoustics, 1995, 15-18 Oct. 1995, pp. 169-172

The invention claimed is:

1. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound; and a first signal processing unit (SPU-1) configured to process a first SPU-1-input signal, to provide a first frequency dependent forward gain G-11, and to provide a corresponding processed G-11-output signal; and the second hearing instrument including a second input transducer for converting a second input sound to a second electric input signal, and a second output transducer for converting a second processed electric output signal to a second output sound, the system being configured to provide that a first Tx-signal originating from the first electric input signal of the first hearing instrument is transmitted to the second hearing instrument and used in the formation of the second processed electric output signal, that a second Tx-signal originating from the second electric input signal of the second hearing instrument is transmitted to the first hearing instrument and used in the formation of the first processed electric output signal, to provide that the first SPU-1-input signal originates from the second Tx-signal, and the system is configured to provide that the first processed electric output signal originates from the processed G-11-output signal.

2. A hearing aid system according to claim 1, wherein the first signal processing unit (SPU-1) is configured to process a second SPU-1-input signal, for providing a second frequency dependent forward gain G-12, and to provide a corresponding processed G-12-output signal, and the system is configured to provide that the second SPU-1-input signal originates from the first electric input signal.

3. A hearing aid system according to claim 1, wherein the system is configured to provide that the first Tx-signal is equal to the first electric input signal.

4. A hearing aid system according to claim 1, wherein the second hearing instrument comprises a second signal processing unit (SPU-2) for processing a first SPU-2-input signal, providing a first frequency dependent forward gain G-21, and providing a corresponding processed G-21-output signal, and wherein the system is configured to provide that the first SPU-2-input signal originates from the first Tx-signal.

5. A hearing aid system according to claim 4 wherein the second signal processing unit (SPU-2) is adapted for processing a second SPU-2-input signal, for providing a second frequency dependent forward gain G-22, and for providing a corresponding processed G-22-output signal, and wherein the system is adapted to provide that the second SPU-2-input signal originates from the second electric input signal.

6. A hearing aid system according to claim 5, wherein the system is configured to provide that the second processed electric output signal originates from a combination of the processed G-21-output signal and the processed G-22-output signal.

7. A hearing aid system according to claim 4, wherein the system is configured to provide that the second processed electric output signal originates from the processed G-21-output signal.

8. A hearing instrument according to claim 1, wherein the signal processing unit (SPU-1, SPU-2) is configured to process the SPU-input signal(s) in the frequency domain in a number N of frequency bands $FB_i$, the signal processing unit providing a forward gain $G_i$ in each band, i=1, 2, . . . , N.

9. A hearing aid system according to claim 8 configured to provide that loop gain is smaller than one in at least one of the frequency bands $FB_i$ considered by the system, i=1, 2, . . . , N, $LG_k(f)=|H_1(f)\cdot G_2(f)\cdot H_2(f)\cdot G_1(f)|<1$, for all frequencies fin the $k^{th}$ k frequency band.

10. A hearing aid system according to claim 8 configured to determine the frequency band or bands that produce feedback oscillation.

11. A hearing aid system according to claim 10 adapted to dynamically, with a certain frequency over time, determine the frequency band or bands most likely to produce feedback oscillation.

12. A hearing aid system according to claim 10 configured to provide that $LG_q(f)=|H_1(f)\cdot G_2(f)\cdot H_2(f)\cdot G_1(f)|<1$, for all frequencies f in the frequency band or bands $FB_q$ detected to produce feedback oscillation.

13. A hearing aid system according to claim 8 configured to, in advance of its use, determine the frequency band or bands that produce feedback oscillation.

14. A hearing aid system according to claim 8 adapted to provide that the forward gains $G_{i1}$ and $G_{i2}$ of the frequency bands $FB_{i1}$ and $FB_{i2}$ of the first and second hearing instruments, respectively, are complementary to each other.

15. A hearing aid system according to claim 1, configured to preserve directional cues of the input sound signals to the first and second hearing instruments.

16. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound;

a first signal processing unit (SPU-1) configured to process a first SPU-1-input signal, to provide a first frequency dependent forward gain G-11, and to provide a corresponding processed G-11-output signal, and to process a second SPU-1-input signal, to provide a second frequency dependent forward gain G-12, and to provide a corresponding processed G-12-output signal; and the second hearing instrument including a second input transducer for converting a second input sound to a second electric input signal, and a second output transducer for converting a second processed electric output signal to a second output sound, the system being configured to provide that a first Tx-signal originating from the first electric input signal of the first hearing instrument is transmitted to the second hearing instrument and used in the formation of the second processed electric output signal, that a second Tx-signal originating from the second electric input signal of the second hearing instrument is transmitted to the first hearing instrument and used in the formation of the first processed electric output signal, to provide that the first SPU-1-input signal originates from the second Tx-signal, to provide that the second SPU-1-input signal originates from the first electric input signal, and the system is configured to provide that the first processed electric output signal originates from a combination of the processed G-11-output signal and the processed G-12-output signal.

17. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound; and a first signal processing unit (SPU-1) configured to process a first SPU-1-input signal and a second SPU-1 input signal, to provide a first frequency dependent forward gain G-11 and a second frequency dependent forward gain G-12, and to provide a corresponding processed G-11-output signal and corresponding processed G-12-output signal; and the second hearing instrument including a second input transducer for converting a second input sound to a second electric input signal, and a second output transducer for converting a second processed electric output signal to a second output sound, the system being configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, to provide that the first SPU-1-input signal originates from the second Tx-signal, to provide that the second SPU-1-input signal originates from the first electric input signal, and wherein the system is configured to provide that the first Tx-signal originates from the processed G-12-output signal.

18. A hearing aid system according to claim 17 wherein the system is adapted to provide that the second processed electric output signal is equal to the first Tx-signal.

19. A hearing aid system, comprising:

first and second spatially separated hearing instruments, the system being configured to process input sounds to output sounds according to a user's needs, the first hearing instrument including a first input transducer for converting a first input sound to a first electric input signal, and a first output transducer for converting a first processed electric output signal to a first output sound, the second hearing instrument including a second input transducer for converting a second input sound to a second electric input signal, and a second output transducer for converting a second processed electric output signal to a second output sound, the system being configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, and to provide that loop gain is smaller than one, loop gain LG being given by $LG=|H_1 \cdot G_2 \cdot H_2 \cdot G_1|<1$, where $H_n$ is the acoustic feedback transfer function and $G_i$ is the forward transfer function of hearing instrument n, where n=1, 2.

20. A hearing aid system according to claim 19 configured to provide that loop gain is smaller than one at all frequencies f considered by the system, $LG(f)=|H_1(f) \cdot G_2(f) \cdot H_2(f) \cdot G_1(f)|<1$, for all frequencies in the frequency range, $f_{min} \leq f \leq f_{max}$, where $f_{min}$ is 20 Hz and $f_{max}$ is 12 kHz.

21. A hearing aid system according to claim 19 adapted to provide that $G_1$ and $G_2$ are 'complementary to each other' in that $|G_1 \cdot G_2|<1/|H_1 \cdot H_2|$.

22. A hearing aid system, comprising:

first and second spatially separated hearing instruments, the system being configured to process input sounds to output sounds according to a user's needs, the first hearing instrument including a first input transducer for converting a first input sound to a first electric input signal, and a first output transducer for converting a first processed electric output signal to a first output sound, the second hearing instrument including a second input transducer for converting a second input sound to a second electric input signal, and a second output transducer for converting a second processed electric output signal to a second output sound, the system being configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, to preserve directional cues of the input sound signals to the first and second hearing instruments, and to utilize a prerecorded tabulation of the transfer functions from left-to-right and from right-to-left ear, $H_{LR}(\omega,\alpha)$ and $H_{RL}(\omega,\alpha)$, respectively, to preserve the directional cues of the input sound signals to the first and second hearing instruments.

23. A hearing aid system according to claim 22 adapted to tabulate the acoustic feedback transfer functions $H_{LR}(\omega,\alpha)$ and/or $H_{RL}(\omega,\alpha)$ for different directions of arrival $\alpha$ of the target signal, where $\alpha$ is the angle of incidence of the target acoustic signal in the horizontal plane.

24. A hearing aid system according to claim 22 adapted to tabulate the acoustic feedback transfer functions $H_{LR}(\omega,\phi)$ and/or $H_{RL}(\omega,\phi)$ for different directions of arrival $\phi$ of the target signal, where $\phi$ is the angle of elevation relative to a horizontal plane of the target acoustic signal.

25. A hearing aid system according to claim 22 configured to compensate the directional cues by convolving the signal picked up from a given angle in the left ear with the impulse response corresponding to $H_{LR}(\omega,\alpha,\phi)$, and vice-versa for the right ear.

26. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound; and a first signal processing unit (SPU-1) configured to process a first SPU-1-input signal, to provide a first frequency dependent forward gain G-11, and to provide a corresponding processed G-11-output signal; and the second hearing instrument including a second input transducer for converting a second input sound to a second electric input signal, and a second output transducer for converting a second processed electric output signal to a second output sound, wherein the system is configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, and to provide that the first SPU-1-input signal originates from the second Tx-signal, the signal processing unit (SPU-1, SPU-2) is configured to process the SPU-input signal(s) in frequency domain in a number N of frequency bands $FB_i$, the signal processing unit providing a forward gain $G_i$ in each band, i=1, 2, . . . , N, and the system is further configured to provide that a sub-range $SB_{i1j}$ of a given frequency band $FB_{i1}$ of the first hearing instrument is set to a relatively low value $G_{low,i1j}$ of the forward gain and the corresponding sub-range $SB_{i2j}$ of the corresponding frequency band $FB_{i2}$ of the second hearing instrument is set to a relatively high value $G_{high,i2j}$ of the forward gain, and that a neighboring sub-range $SB_{i1(j+1)}$ of said frequency band $FB_{i1}$ of the first hearing instrument is set to a relatively high value $G_{high,i1(j+1)}$ and the corresponding sub-range $SB_{i2(j+1)}$ of the corresponding frequency band $FB_{i2}$ of the second hearing instrument is set to a relatively low value $G_{low,i2(j+1)}$, or vice versa.

27. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound; and a first signal processing unit (SPU-1) configured to process a first SPU-1-input signal, to provide a first frequency dependent forward gain G-11, and to provide a corresponding processed G-11-output signal; and the second hearing instrument including a second input transducer for converting a second input sound to a second electric input signal, and a second output transducer for converting a second processed electric output signal to a second output sound, wherein the system is configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, to provide that the first SPU-1-input signal originates from the second Tx-signal, the signal processing unit (SPU-1, SPU-2) is configured to process the SPU-input signal(s) in frequency domain in a number N of frequency bands $FB_i$, the signal processing unit providing a forward gain $G_i$ in each band, i=1, 2, . . . , N, and frequency bands $FB_{i1}$, $FB_{i2}$ of the first and second hearing instruments each comprise two sub-bands, $SB_{i11}$, $SB_{i12}$ and $SB_{i21}$, $SB_{i22}$, respectively, each constituting half of the frequency range of that band.

28. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound; and a first signal processing unit (SPU-1) configured to process a first SPU-1-input signal, to provide a first frequency dependent forward gain G-11, and to provide a corresponding processed G-11-output signal; and the second hearing instrument including a second input transducer for converting a second input sound to a second electric input signal, and a second output transducer for converting a second processed electric output signal to a second output sound, wherein the system is configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, to provide that the first SPU-1-input signal originates from the second Tx-signal, the signal processing unit (SPU-1, SPU-2) is configured to process the SPU-input signal(s) in frequency domain in a number N of frequency bands $FB_i$, the signal processing unit providing a forward gain $G_i$ in each band, i=1, 2, . . . , N, the system is configured to provide that at least some of the frequency bands $FB_{i1}$, $FB_{i2}$ of the first and second hearing instruments are arranged according to critical bands as defined by auditory perception theory, and the system is configured to provide that the frequency bands $FB_{i1}$, $FB_{i2}$ are arranged to provide that a given desired signal power is present within each critical band while still avoiding feedback problems.

29. A hearing aid system, comprising:

first and second spatially separated hearing instruments, the system being configured to process input sounds to output sounds according to a user's needs, the first hearing instrument including a first input transducer for converting a first input sound to a first electric input signal;

a first output transducer for converting a first processed electric output signal to a first output sound; and a first signal processing unit (SPU-1) configured to process a first SPU-1-input signal, to provide a first frequency dependent forward gain G-11, and to provide a corresponding processed G-11-output signal; and the second hearing instrument including a second input transducer for converting a second input sound to a second electric input signal, and a second output transducer for converting a second processed electric output signal to a second output sound, wherein the system is configured to provide that a first Tx-signal originating from the first electric input signal of the first hearing instrument is transmitted to the second hearing instrument and used in the formation of the second processed electric output signal, to provide that a second Tx-signal originating from the second electric input signal of the second hearing instrument is transmitted to the first hearing instrument and used in the formation of the first processed electric output signal, to provide that the first SPU-1-input signal originates from the second Tx-signal, the signal processing unit (SPU-1, SPU-2) is configured to process the SPU-input signal(s) in frequency domain in a number N of frequency bands $FB_i$, the signal processing unit providing a forward gain $G_i$ in each band, i=1, 2, . . . , N, the system is configured to provide that at least some of the frequency bands $FB_{i1}$, $FB_{i2}$ of the first and second hearing instruments are arranged according to critical bands as defined by auditory perception theory, and the system is configured to provide that the frequency bands $FB_{i1}$, $FB_{i2}$ comprise both relatively high and relatively low gain values within each critical band.

30. A method of reducing acoustic feedback in a hearing aid system comprising first and second hearing instruments, the system being configured to process input sounds to output sounds according to a user's needs, the method comprising:

converting an input sound to a first and a second electric input signal, respectively;

converting first and second processed electric output signals, respectively, to an output sound;

transmitting a first Tx-signal originating from the first electric input signal of the first hearing instrument to the second hearing instrument;

using the first Tx-signal in the formation of the second processed electric output signal;

transmitting a second Tx-signal originating from the second electric input signal of the second hearing instrument to the first hearing instrument;

using the second Tx-signal in the formation of the first processed electric output signal; and setting loop gain to less than one, loop gain LG being given by $LG=|H_1 \cdot G_2 \cdot H_2 \cdot G_1|<1$, where $H_n$ is the acoustic feedback transfer function and $G_i$ is the forward transfer function of hearing instrument n, where n=1, 2.

* * * * *